US011232938B2

(12) United States Patent
Arnold et al.

(10) Patent No.: US 11,232,938 B2
(45) Date of Patent: Jan. 25, 2022

(54) SAMPLING PROBE AND SAMPLING INTERFACE FOR MASS SPECTROMETRY

(71) Applicant: DH Technologies Development Pte. Ltd., Singapore (SG)

(72) Inventors: Don W Arnold, Livermore, CA (US); Thomas R Covey, Richmond Hill (CA); Chang Liu, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 17/255,861

(22) PCT Filed: Jun. 28, 2019

(86) PCT No.: PCT/IB2019/055505
§ 371 (c)(1),
(2) Date: Dec. 23, 2020

(87) PCT Pub. No.: WO2020/003233
PCT Pub. Date: Jan. 2, 2020

(65) Prior Publication Data

US 2021/0265150 A1 Aug. 26, 2021

Related U.S. Application Data

(60) Provisional application No. 62/692,274, filed on Jun. 29, 2018.

(51) Int. Cl.
*H01J 49/16* (2006.01)
*H01J 49/04* (2006.01)

(52) U.S. Cl.
CPC ..... *H01J 49/0404* (2013.01); *H01J 49/0459* (2013.01); *H01J 49/16* (2013.01)

(58) Field of Classification Search
CPC ..... H01J 49/0404; H01J 49/0459; H01J 49/16
USPC ..... 250/281, 282, 288
See application file for complete search history.

(56) References Cited

U.S. PATENT DOCUMENTS 4,988,447 A 1/1991 Hellinger
7,679,053 B2 3/2010 Schneider et al.
9,153,425 B2 * 10/2015 Van Berkel ..... H01J 49/0431
(Continued)

OTHER PUBLICATIONS

International Search Report and Written Opinion for PCT/IB2019/055505 dated Dec. 10, 2019.

*Primary Examiner* — Michael Maskell

(57) ABSTRACT

Methods and systems for delivering liquid sample to an ion source and subsequent analysis by mass spectrometry. In accordance with various aspects of the present teachings, MS-based systems and methods are provided in which desorption solvent is used in sampling interface to desorb analyte species from an SPME device that is coupled to an ion source to ionize analyte species desorbed into the desorption solvent for MS analysis (e.g., without a liquid chromatography (LC) column between the sampling interface and the ion source). In various aspects of the methods and systems described herein, configuring the sampling interface can be optimized so as to reduce the fluid volume dead space about the fluid inlet so as to concentrate the one or more analyte species desorbed at optimized conditions from the SPME substrate in a decreased volume of the desorption solvent when the SPME device is inserted into sampling interface.

20 Claims, 10 Drawing Sheets

(56) References Cited

U.S. PATENT DOCUMENTS

| | | | |
|---|---|---|---|
| 9,176,028 | B2 | 11/2015 | ElNaggar et al. |
| 9,632,066 | B2 | 4/2017 | Van Berkel |

* cited by examiner

SAMPLING PROBE AND SAMPLING INTERFACE FOR MASS SPECTROMETRY

This application claims the benefit of priority from U.S. Provisional Application Ser. No. 62/692,274, filed on Jun. 29, 2018, the entire contents of which is incorporated by reference herein.

FIELD

The present teachings generally relate to mass spectrometry, and more particularly to sampling probes and sampling interfaces for mass spectrometry systems and methods.

INTRODUCTION

Mass spectrometry (MS) is an analytical technique for determining the elemental composition of test substances with both qualitative and quantitative applications. MS can be useful for identifying unknown compounds, determining the isotopic composition of elements in a molecule, determining the structure of a particular compound by observing its fragmentation, and quantifying the amount of a particular compound in a sample. Given its sensitivity and selectivity, MS is particularly important in life science applications.

In the analysis of complex sample matrices (e.g., biological, environmental, and food samples), many current MS techniques require extensive pre-treatment steps to be performed on the sample prior to MS detection/analysis of the analyte of interest. Such pre-analytical steps can include sampling (i.e., sample collection) and sample preparation (separation from the matrix, concentration, fractionation and, if necessary, derivatization). It has been estimated, for example, that more than 80% of the overall analytical process can be spent on sample collection and preparation in order to enable the analyte's detection via MS or to remove potential sources of interference contained within the sample matrix, while nonetheless increasing potential sources of dilution and/or error at each sample preparation stage.

Ideally, sample preparation techniques for MS should be fast, reliable, reproducible, inexpensive, and in some aspects, amenable to automation. One recent example of an improved sample preparation technique is solid-phase microextraction (SPME), which essentially integrates sampling, sample preparation, and extraction into a single solvent-free step. Generally, SPME devices utilize a fiber or other surface (e.g., blades, micro-tips, pins, or mesh) coated with an extracting phase to which analytes within the sample can be preferentially adsorbed when the device is inserted into the sample. Because extraction can take place in situ by inserting a biocompatible device directly into tissue, blood, or other biological matrix for a short period of time, SPME does not require any additional sample collection. Alternatively, SPME devices can be used for ex vivo analysis using a small amount of a collected sample (e.g., a sample aliquot).

Though SPME is generally considered to be accurate and simple and can result in decreased sample preparation time and disposal costs, the MS-based analysis of SPME-prepared samples may nonetheless require additional equipment and/or time-consuming steps in order to ionize the analyte from the SPME device directly or to desorb the analytes from the SPME device prior to ionization as required for MS. By way of example, various ionization methods have been developed that can desorb/ionize analytes from condensed-phase samples with minimal sample handling (e.g., desorption electrospray ionization (DESI) and direct analysis in real time (DART), which "wipe-off" analytes from the samples by exposing their surfaces to an ionizing medium such as a gas or an aerosol). However, such techniques can also require sophisticated and costly equipment. In addition, the ionization efficiency of large molecules (e.g., proteins) are generally not as good as small molecules for these ionization techniques.

Alternatively, additional desorption steps have been utilized to extract the analytes from the SPME device prior to ionization via ionization techniques other than DESI or DART. For example, because electrospray ionization (ESI) is one of the most common ionization methods and requires the analyte to be in solution, some users have utilized liquid desorption and subsequent purification/separation of the extracted/enriched analytes via high-performance liquid chromatography (HPLC) prior to MS analysis. However, liquid desorption prior to HPLC may require several minutes to transfer the analyte from the SPME coating to the liquid phase due to requirements imposed on the HPLC mobile phase (weak solvent strength). Typically, high organic solvent has the best elution efficiency, but it cannot be injected directly to the typically-used reverse-phase LC columns. In order to compensate, either an elution solvent having less efficacy (e.g., a mixture of organic solvent and water) is typically utilized, or a follow-up dilution step with water prior to the LC injection is alternatively provided. Both options, however, can reduce sensitivity. Such conventional workflows of elution and LC-MS ejection also generally require a relatively high volume of liquid to be used in the elution step, which leads to additional dilution. Moreover, as discussed above, these increased sample preparation/separation steps can decrease throughput, introduce potential sources of error, increase dilution, and cannot be easily automated. Alternatively, some groups have proposed substantial modifications to the standard electrospray ion source. Typically in ESI, a liquid sample is continuously discharged into an ionization chamber from within an electrically conductive capillary, while an electric potential difference between the capillary and a counter electrode generates a strong electric field within the ionization chamber that electrically charges the liquid sample. This electric field causes the liquid discharged from the capillary to disperse into a plurality of charged micro-droplets drawn toward the counter electrode if the charge imposed on the liquid's surface is strong enough to overcome the surface tension of the liquid (i.e., the particles attempt to disperse the charge and return to a lower energy state). As solvent within the micro-droplets evaporates during desolvation in the ionization chamber, charged analyte ions can then enter a sampling orifice of the counter electrode for subsequent mass spectrometric analysis. PCT Pub. No. WO2015188282 entitled "A Probe For Extraction Of Molecules Of Interest From A Sample," which is incorporated by reference herein in its entirety, for example, thus purports to provide for electrospray ionization from an SPME device by applying the ionizing electric potential to the conductive SPME device itself (to which a discrete amount of a desorption solution is applied) such that ions are generated directly from the edges of the wetted substrate.

There remains a need for improved and/or reduced-cost systems that enable fast-coupling of SPME devices to MS systems with minimal alterations to the front-end while maintaining sensitivity, simplicity, selectivity, speed, and throughput.

There also remains a need for the efficient coupling of liquid samples (whether undergoing pre-sampling purification or otherwise to the ion source of a mass spectrometer system).

SUMMARY

Devices, methods, and systems for delivering a liquid sample to an ion source for the generation of ions and subsequent analysis by mass spectrometry are provided herein. In accordance with various aspects of the present teachings, MS-based systems and methods are provided in which a desorption solvent utilized in a sampling interface to desorb one or more analyte species from a substrate is fluidly coupled to an ion source for ionizing the one or more analyte species desorbed into the desorption solvent for subsequent MS analysis (e.g., without a liquid chromatography (LC) column between the sampling interface and the ion source). In accordance with various aspects of the devices, methods, and systems described herein, the configuration of the sampling substrate (e.g., a SPME device to which extracted analytes are adsorbed) and/or the sampling interface can be optimized so as to increase the surface area of the substrate coated with the extraction phase subject to desorption within a minimal volume of desorption solvent within the fluid chamber of the sampling interface so as to provide for increased concentrations of the one or more analyte species desorbed from the substrate in the desorption solvent delivered to the ion source of the MS system. In some aspects, for example, the substrate can be configured such that the substrate occupies at least 20 percent of the fluid volume in the device-receiving port (i.e., less than 80% of the volume of the device-receiving port is occupied by desorption solvent). By way of non-limiting example, in some aspects, the substrate can occupy at least 30%, at least 40%, or at least 50% of the distal fluid chamber.

In accordance with various exemplary aspects of the present teachings, a substrate for sampling a specimen is provided, the substrate comprising an elongate member extending from a first end to a second end spaced apart from the first end by an outer surface and a bore extending from the second end at least partially through the elongate member. The second end of the elongate member can be sized and configured to be inserted within a substrate sampling probe (e.g., within a port of an open port probe). In various exemplary aspects, the substrate sampling probe can comprise an outer capillary tube extending from a proximal end to a distal end and an inner capillary tube extending from a proximal end to a distal end and disposed within said outer capillary tube (e.g., coaxially), with the distal end of the inner capillary tube being recessed relative to the distal end of the outer capillary tube so as to define a distal fluid chamber between the distal end of the inner capillary tube and the distal end of the outer capillary tube. In such a manner, the inner and outer capillary tubes of the substrate sampling probe can define a desorption solvent conduit and a sampling conduit in fluid communication with one another via the distal fluid chamber. In various aspects, the bore defines an inner surface of the elongate member that is sized and configured to at least partially surround the distal end of the inner capillary tube, for example, when the substrate is inserted into the distal fluid chamber. Further, at least a portion of the elongate member's outer surface, the bore's inner surface, and the second end of the elongate member can comprise a surface coated with an extraction phase to which one or more analytes in a sample can be preferentially adsorbed when the device is inserted into the sample. Additionally, the cross-sectional shape of the elongate member at the coated surface portion can comprise a plurality of protrusions on at least one of the inner and outer surfaces such that desorption solvent flowing from the desorption solvent conduit into the sampling conduit through the distal fluid chamber can flow around said protrusions to desorb analytes adsorbed thereto.

The inner and outer surfaces of the sampling substrate can have a variety of configurations for increasing the surface area to which analytes can be adsorbed during extraction and from which analytes can be desorbed for delivery to the ion source in the sampling interface. By way of example, the inner surface of the bore at the coated surface portion can comprise a circular cross-sectional shape, while for example, the cross-sectional shape of the outer surface comprises a star-like shape (e.g., like a plurality of baffles). In some aspects, the maximum outer dimension of the outer surface at the coated surface portion comprising protrusions is less than the inner dimension of the outer capillary tube, while the minimum inner diameter of the circular bore can be greater than the outer diameter of the inner capillary tube. Alternatively, in some aspects, the outer surface of the elongate member at the coated surface portion can comprise a circular cross-sectional shape and the plurality of protrusions can be formed in the inner surface, for example, as inwardly extending baffles. For example, the minimum inner dimension of the inner protrusions of the non-circular bore can be greater than the outer diameter of the inner capillary tube to allow the inner capillary to be disposed therein, while the diameter of the circular outer surface of the elongate member can be less than the inner dimension of the outer capillary tube.

In various aspects, the elongate member extends along a longitudinal axis from its first end to its second end, and at least a portion of the elongate member can be axially symmetric thereabout (e.g., at the coated surface portion). In some aspects, the entire elongate member can be axially symmetric.

In certain aspects, the coated surface of the sampling substrate (e.g., SPME device) comprises a solid phase extraction medium such as HLB-PAN, C18-PAN, antibodies, etc., all by way of non-limiting example.

In various aspects, the substrate can be configured to rotate within the sample and/or desorption solvent so as to improve mass transfer (e.g., increase extraction or desorption speed). In addition to an actuation mechanism of a sample holder, for example, the first end of the elongate member can comprise a plurality of magnets, for example, that together serve as rotors when energized by an alternating current.

In accordance with various exemplary aspects of the present teachings, a system for analyzing the chemical composition of one or more analytes adsorbed to a sampling substrate as discussed otherwise herein is provided. In various aspects, the desorption solvent conduit and the sampling conduit can be in fluid communication with one another via the distal fluid chamber within which the substrate can be inserted. In various aspects, the desorption solvent conduit can extend from an inlet end configured to fluidly couple to a desorption solvent source to an outlet end in fluid communication with the distal fluid chamber, and said sampling conduit can extend from an inlet end in fluid communication with the distal fluid chamber to an outlet end configured to fluidly couple to an ion source probe for discharging desorption solvent received at the inlet end of the sampling conduit into an ionization chamber in fluid communication with a sampling orifice of a mass spectrometer.

In various related aspects, the system can further comprise a desorption solvent source fluidly coupled to the inlet end of the desorption solvent conduit and a pump mechanism for delivering the desorption solvent from the desorption solvent source to the inlet end of the desorption solvent conduit. In further aspects, the system can further comprise a controller for adjusting a fluid flow rate of the desorption solvent flowing through one or more of the desorption solvent conduit, the sampling conduit, and the ion source probe. Additionally or alternatively, the system can further comprise an ion source probe, an ionization chamber, and a mass spectrometer system, wherein the ion source probe is in fluid communication with the outlet end of the sampling conduit and comprises a distal end disposed in the ionization chamber, wherein analytes contained within said desorption solvent are configured to ionize as the desorption solvent is discharged into the ionization chamber.

In various aspects, the system can additionally include a sample holder that can enable SPME-MS analysis in an automated fashion. In various aspects, for example, the sample holder can be configured to insert the substrate within the sampling probe such that the coated surface portion is disposed within the distal fluid chamber. Additionally, in certain aspects, the sample holder can include an actuation mechanism to rotate the elongate member about its longitudinal axis when the coated surface portion is disposed within the distal fluid chamber to increase desorption therefrom. Additionally or alternatively, an actuation mechanism coupled to the sample holder can be configured to insert the substrate into the distal end of the outer capillary tube such that the coated surface portion of said substrate is in contact with the desorption solvent. In such a manner, various steps of the chemical analysis procedures performed by the exemplary systems described herein can be automated (e.g., performed by a robotic system). In some aspects, for example, the system can comprise a specimen stage configured to support a plurality of substrates, wherein the actuation mechanism is configured to sequentially insert each of said plurality of substrates into the distal end of the outer capillary tube. In some related aspects, though the desorption process and MS-sampling may be performed sequentially, the actuation mechanism can be configured to pretreat a plurality of substrates simultaneously to increase throughput (e.g., pre-conditioning of the SPME substrate, sampling, and rinsing steps).

In accordance with various aspects of the present teachings, systems for analyzing a chemical composition of a specimen are provided comprising a substrate sampling probe configured to be directly coupled to an ion source of a mass spectrometer system.

In accordance with various exemplary aspects of the present teachings, a method for performing chemical analysis is provided, the method comprising providing a system for analyzing the chemical composition of one or more analytes adsorbed to a sampling substrate as discussed otherwise herein. The method can also include inserting the second end of the elongate member into the distal fluid chamber of the substrate sampling probe such that at least a portion of the inner capillary tube is disposed within the bore of the elongate member and flowing a desorption solvent through the desorption fluid pathway such that at least a portion of the one or more analyte species is desorbed from the coated surface portion and delivered to the ion source probe within the desorption solvent via the sampling conduit. The desorption solvent containing the portion of the one or more analyte species can then be discharged from the ion source probe so as to ionize the one or more analyte species and mass spectrometric analysis can be performed on the one or more ionized analyte species. In some related aspects, the method can additionally include interacting the coated surface portion with a sample so as to adsorb the one or more analyte species to the coated surface portion. Additionally or alternatively, the method can also comprise rotating the elongate member about its longitudinal axis when the coated surface portion is disposed within the distal fluid chamber, for example, to increase the efficiency of analyte desorption within the desorption solvent.

In accordance with various exemplary aspects of the present teachings, a system and method for analyzing a chemical composition of a specimen is described, comprising: a substrate sampling probe comprising: an outer capillary tube extending from a proximal end to a distal end; and an inner capillary tube extending from a proximal end to a distal end and disposed within said outer capillary tube, wherein said distal end of the inner capillary tube is recessed relative to the distal end of the outer capillary tube so as to define a distal fluid chamber between the distal end of the inner capillary tube and the distal end of the outer capillary tube, wherein said inner and outer capillary tubes define a desorption solvent conduit and a sampling conduit in fluid communication with one another via said distal fluid chamber, said desorption solvent conduit extending from an inlet end configured to fluidly couple to a desorption solvent source to an outlet end in fluid communication with said distal fluid chamber, and said sampling conduit extending from an inlet end in fluid communication with said distal fluid chamber to an outlet end configured to fluidly couple to an ion source probe for discharging desorption solvent received at the inlet end of the sampling conduit into an ionization chamber in fluid communication with a sampling orifice of a mass spectrometer; and a substrate comprising an elongate member extending from a first end to a second end spaced apart from the first end by an outer surface, wherein the second end is sized and configured to be inserted within the distal fluid chamber, wherein the elongate member has a bore at least partially extending therethrough from the second end and defining an inner surface that is configured to at least partially surround the distal end of the inner capillary tube when the second end is inserted within the distal fluid chamber, and wherein at least a portion of said outer surface, said inner surface, and said second end of the elongate member comprises a surface coated with an extraction phase configured to adsorb one or more analyte species thereto, a first and second solvent source fluidly connected to the desorption solvent conduit; and a controller configured to control individual flow rates of first and second solvents from the first and second solvent sources, respectively, to the desorption solvent conduit.

In accordance with various exemplary aspects of the present teachings, a system and method for performing chemical analysis is described (utilizing devices described herein by way of example), the method comprising: inserting the second end of the elongate member into the distal fluid chamber of the substrate sampling probe such that at least a portion of the inner capillary tube is disposed within the bore of the elongate member; flowing a first composition of desorption solvent comprising the first and second solvents into said desorption solvent conduit such that at least a first portion of said one or more analyte species is desorbed from the coated surface portion and delivered to the ion source probe within said desorption solvent via the sampling conduit; flowing a second composition of desorption solvent comprising the first and second solvents into said desorption solvent conduit, the second composition differing from the first composition, such that at least a second portion of said one or more analyte species is desorbed from the coated surface portion and delivered to the ion source probe within said desorption solvent via the sampling conduit; discharging said first and second compositions of desorption solvents containing said first and second portions of the one or more analyte species from said ion source probe so as to ionize said one or more analyte species; and performing mass spectrometric analysis on said one or more ionized analyte species.

In accordance with various exemplary aspects of the present teachings a system for analyzing a chemical composition of a specimen is provided, comprising: a substrate sampling probe comprising: an outer capillary tube extending from a proximal end to a distal end; and an inner capillary tube extending from a proximal end to a distal end and disposed within said outer capillary tube, wherein said distal end of the inner capillary tube is recessed relative to the distal end of the outer capillary tube so as to define a distal fluid chamber between the distal end of the inner capillary tube and the distal end of the outer capillary tube, wherein said inner and outer capillary tubes define a desorption solvent conduit and a sampling conduit in fluid communication with one another via said distal fluid chamber, said desorption solvent conduit extending from an inlet end configured to fluidly couple to a desorption solvent source through a pump to an outlet end in fluid communication with said distal fluid chamber, and said sampling conduit extending from an inlet end in fluid communication with said distal fluid chamber to an outlet end configured to fluidly couple to an ion source probe for discharging desorption solvent received at the inlet end of the sampling conduit into an ionization chamber in fluid communication with a sampling orifice of a mass spectrometer; a pair of electrodes positioned around the distal fluid chamber at a height that defines a desired liquid height, a controller operably connected to the pair of electrodes and the pump, the controller configured such that when a liquid height within the distal fluid chamber is reached, the controller receives a signal from the pair of electrodes that a circuit has been completed and the controller controls the pump so as the maintain the liquid height at the desired liquid height; and a substrate comprising an elongate member extending from a first end to a second end spaced apart from the first end by an outer surface, wherein the second end is sized and configured to be inserted within the distal fluid chamber, wherein the elongate member has a bore at least partially extending therethrough from the second end and defining an inner surface that is configured to at least partially surround the distal end of the inner capillary tube when the second end is inserted within the distal fluid chamber, and wherein at least a portion of said outer surface, said inner surface, and said second end of the elongate member comprises a surface coated with an extraction phase configured to adsorb one or more analyte species thereto.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

Figure 1:
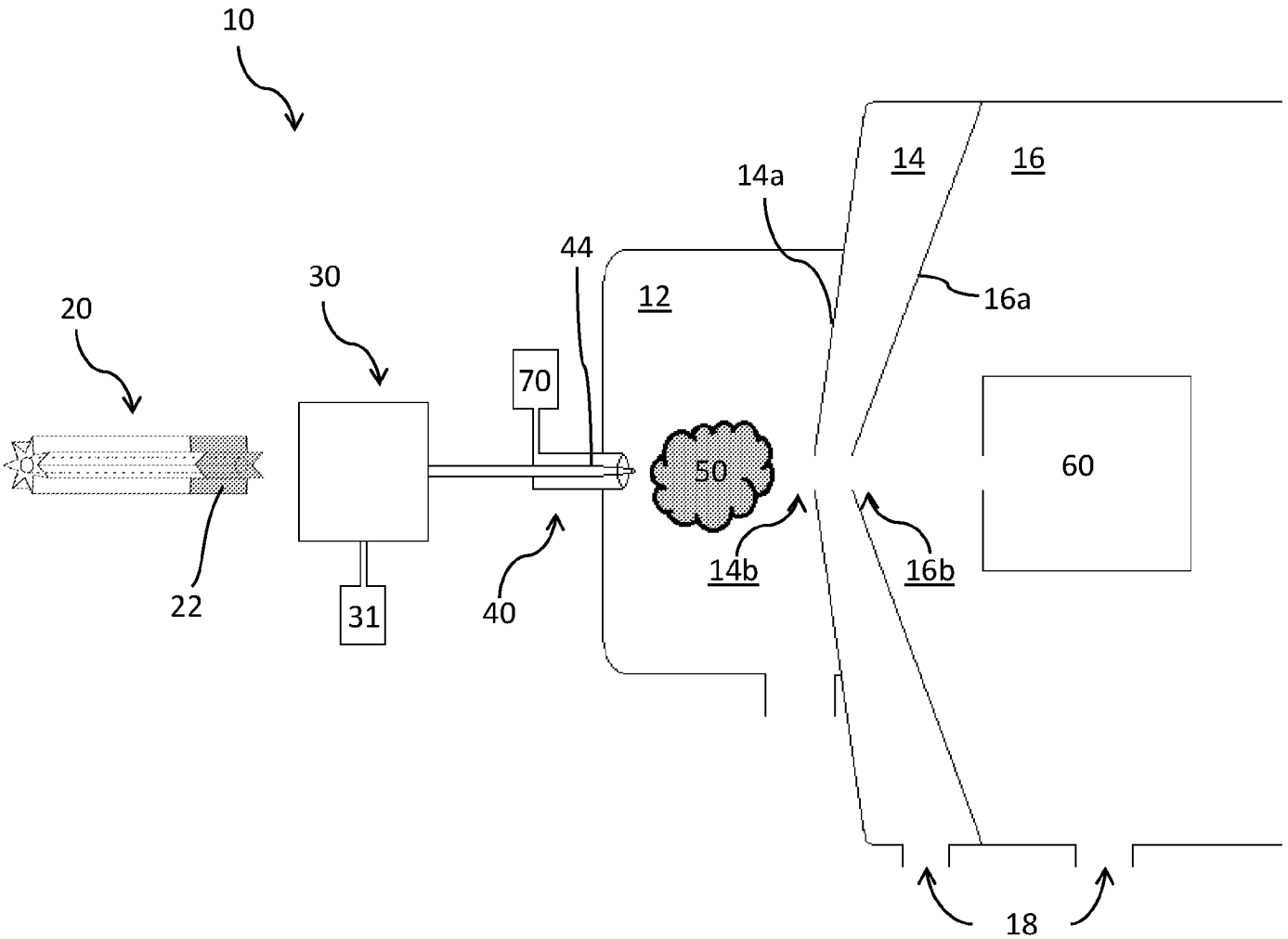
FIG. 1, in a schematic diagram, illustrates an exemplary system comprising a substrate and a substrate sampling interface fluidly coupled to an electrospray ion source of a mass spectrometer system in accordance with various aspects of the applicant's teachings.

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

In accordance with various aspects of the applicant's teachings, MS-based analytical systems and methods are provided herein in which a desorption solvent utilized in a sampling interface to desorb one or more analyte species from a substrate is fluidly coupled to an ion source for ionizing the one or more analyte species desorbed into the desorption solvent for subsequent mass spectrometric analysis (e.g., without a liquid chromatography (LC) column between the sampling interface and the ion source). Whereas current methods for ionizing liquid samples derived from SPME devices often utilize complex sample preparation steps in which the extracted analytes are first desorbed from the substrate and subsequently subject to additional sample processing steps (e.g., concentration/purification via LC) that may not be amenable to automation prior to ionization/mass spectrometric analysis, systems and methods in accordance with various aspects of the present teachings provide a simplified workflow in which the substrates having one or more analytes adsorbed thereon can be coupled directly to the ion source of an MS system. In various aspects, the systems and methods described herein can eliminate the need for one or more time-consuming sample preparation steps while enabling fast coupling of substrates to the MS system (and fast desorption therefrom), with minimal alterations to the front-end of known systems, while nonetheless maintaining sensitivity, simplicity, selectivity, speed, and throughput. Moreover, in various aspects, the present teachings can enable a fully- or partially-automated workflow, thereby further increasing throughput while potentially eliminating sources of human error in the analysis of extracted samples. As discussed in detail below, devices, methods, and systems in accordance with various aspects of the present teachings provide substrates and/or sampling interfaces optimized relative to one another so as to increase the sensitivity of the extraction-based workflow.

In various aspects, the substrate can occupy at least 20 percent of the fluid volume in the substrate-receiving port (i.e., less than 80% of the volume of the substrate-receiving port is occupied by desorption solvent), while maximizing the coated surface area of the substrate that can be disposed in contact with a flowing desorption solvent in the vicinity of a sampling conduit inlet. The portion of the substrate inserted into the substrate sampling probe can have a variety of shapes so as to increase the surface area of the substrate and thereby increase the amount of sample that can be desorbed by the desorption solvent in the distal fluid chamber. In some aspects, for example, the extraction phase coating can be formed on the outer surface of the substrate as well as on a concave inner surface (e.g., a bore) of the substrate that can surround the distal end of the inner capillary tube when the substrate is inserted through the distal end of the outer capillary tube. In various aspects, the outer surface of the substrate or the concave inner surface can be a substantially continuously curved surface having surface features (e.g., a plurality of protrusions) configured to increase the surface area of the coated surface so as to maximize the analytes desorbed in the vicinity of the inlet end of the sampling conduit.

FIG. 1 schematically depicts an embodiment of an exemplary system 10 in accordance with various aspects of the applicant's teachings for ionizing and mass analyzing analytes extracted from substrates. As shown in FIG. 1, the exemplary system 10 generally includes a substrate sampling probe 30 (e.g., an open port probe) in fluid communication with an ion source 40 for discharging a liquid containing one or more sample analytes into an ionization chamber 12, and a mass analyzer 60 in fluid communication with the ionization chamber 12 for downstream processing and/or detection of ions generated by the ion source. As will be discussed in more detail below, the substrate sampling probe 30 is generally configured to receive at least a portion of a substrate 20 (e.g., a SPME substrate) having a surface coated with an extraction phase 22 to which one or more analytes from a sample are adsorbed and which is placed in a fluid pathway in the substrate sampling probe 30 extending between a desorption solvent source 31 and the ion source probe (e.g., electrospray electrode 44). In this manner, analytes desorbed from the coated surface of the substrate 20 by the desorption solvent flow directly to the ion source 40 within the desorption solvent for ionization thereby.

In the depicted embodiment, the ionization chamber 12 can be maintained at an atmospheric pressure, though in some embodiments, the ionization chamber 12 can be evacuated to a pressure lower than atmospheric pressure. The ionization chamber 12, within which analytes desorbed from the substrate 20 and contained in the desorption solvent that is discharged from the electrospray electrode 44 can be ionized, is separated from a gas curtain chamber 14 by a plate 14*a* having a curtain plate aperture 14*b*. As shown, a vacuum chamber 16, which houses the mass analyzer 60, is separated from the curtain chamber 14 by a plate 16*a* having a vacuum chamber sampling orifice 16*b*. The curtain chamber 14 and vacuum chamber 16 can be maintained at a selected pressure(s) (e.g., the same or different sub-atmospheric pressures, a pressure lower than the ionization chamber) by evacuation through one or more vacuum pump ports 18.

The ion source 40 can have a variety of configurations but is generally configured to generate ions from analyte(s) contained within a liquid (e.g., the desorption solvent) that is received from the substrate sampling probe 30. In the exemplary embodiment depicted in FIG. 1, an electrospray electrode 44, which can comprise a capillary fluidly coupled to the substrate sampling probe 20, terminates in an outlet end that at least partially extends into the ionization chamber 12 and discharges the desorption solvent therein. As will be appreciated by a person skilled in the art in light of the present teachings, the outlet end of the electrospray electrode 44 can atomize, aerosolize, nebulize, or otherwise discharge (e.g., spray with a nozzle) the desorption solvent into the ionization chamber 12 to form a sample plume 50 comprising a plurality of micro-droplets generally directed toward (e.g., in the vicinity of) the curtain plate aperture 14*b* and vacuum chamber sampling orifice 16*b*. As is known in the art, analytes contained within the micro-droplets can be ionized (i.e., charged) by the ion source 40, for example, as the sample plume 50 is generated. By way of non-limiting example, the outlet end of the electrospray electrode 44 can be made of a conductive material and electrically coupled to a pole of a voltage source (not shown), while the other pole of the voltage source can be grounded. Micro-droplets contained within the sample plume 50 can thus be charged by the voltage applied to the outlet end such that as the desorption solvent within the droplets evaporates during desolvation in the ionization chamber 12, bare charged analyte ions are released and drawn toward and through the apertures 14*b*, 16*b* and focused (e.g., via one or more ion lens) into the mass analyzer 60. Though the ion source probe is generally described herein as an electrospray electrode 44, it should be appreciated that any number of different ionization techniques known in the art for ionizing liquid samples and modified in accordance with the present teachings can be utilized as the ion source 40. By way of non-limiting example, the ion source 40 can be an electrospray ionization device, a nebulizer assisted electrospray device, a chemical ionization device, a nebulizer assisted atomization device, a photoionization device, a laser ionization device, a thermospray ionization device, or a sonic spray ionization device.

With continued reference to FIG. 1, the mass spectrometer system 10 can optionally include a source 70 of pressurized gas (e.g. nitrogen, air, or noble gas) that supplies a high velocity nebulizing gas flow which surrounds the outlet end of the electrospray electrode 44 and interacts with the fluid discharged therefrom to enhance the formation of the sample plume 50 and the ion release within the plume for sampling by 14*b* and 16*b*, for example, via the interaction of the high speed nebulizing flow and jet of liquid sample. The nebulizer gas can be supplied at a variety of flow rates, for example, in a range from about 0.1 L/min to about 20 L/min.

It will also be appreciated by a person skilled in the art and in light of the teachings herein that the mass analyzer 60 can have a variety of configurations. Generally, the mass analyzer 60 is configured to process (e.g., filter, sort, dissociate, detect, etc.) sample ions generated by the ion source 40. By way of non-limiting example, the mass analyzer 60 can be a triple quadrupole mass spectrometer, or any other mass analyzer known in the art and modified in accordance with the teachings herein. It will further be appreciated that any number of additional elements can be included in the mass spectrometer system including, for example, an ion mobility spectrometer (e.g., a differential mobility spectrometer) that is configured to separate ions based on their mobility through a drift gas rather than their mass-to-charge ratio. Additionally, it will be appreciated that the mass analyzer 60 can comprise a detector that can detect the ions which pass through the analyzer 60 and can, for example, supply a signal indicative of the number of ions per second that are detected.

Figure 2A:
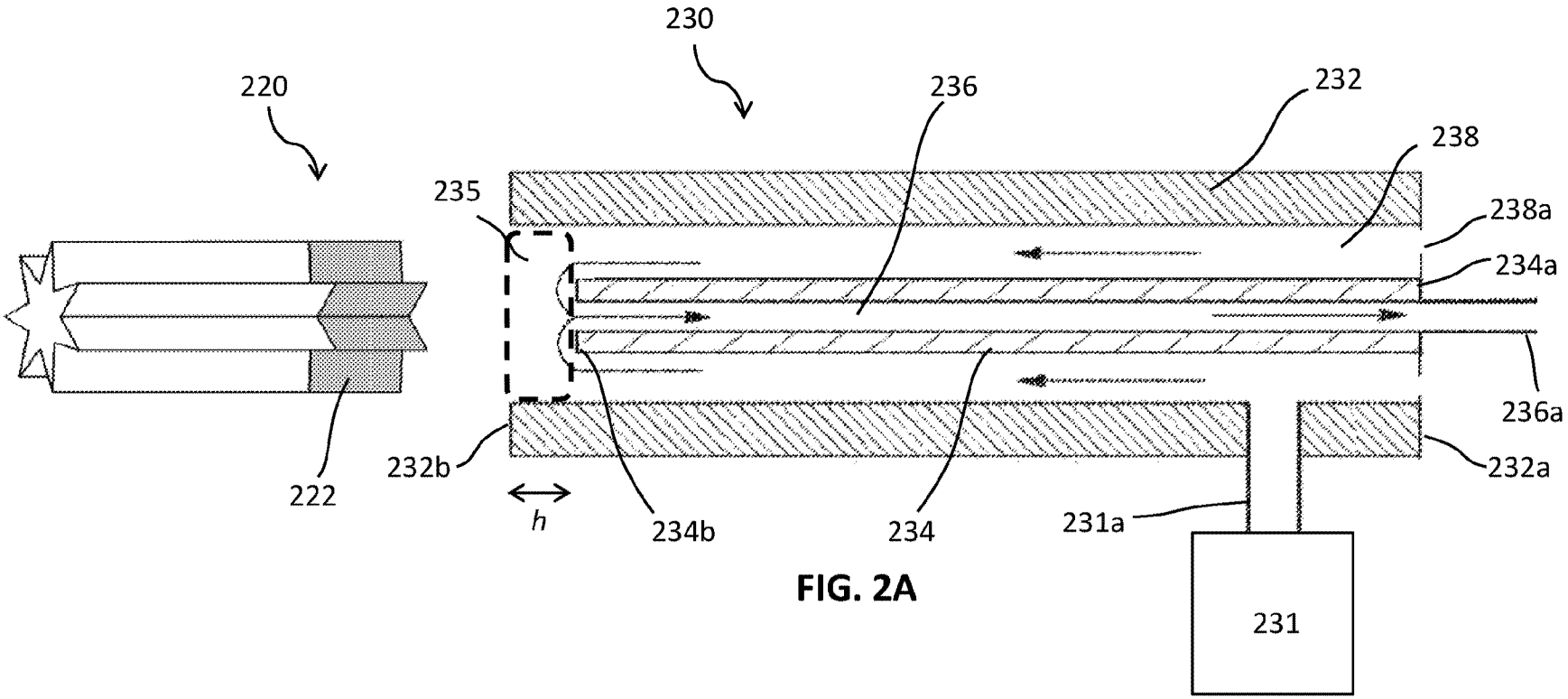
FIGS. 2A-B, in a schematic diagram, illustrates the exemplary substrate and substrate sampling interface of FIG. 1 in additional detail, in accordance with various aspects of the applicant's teachings.
Figure 2B:
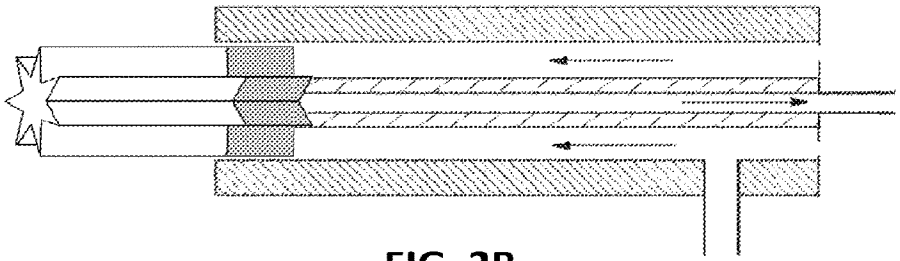

With reference now to FIGS. 2A-2B, an exemplary substrate sampling probe 230 (e.g., an open port probe) for desorbing one or more analytes from a substrate 220 and suitable for use in the system of FIG. 1 is schematically depicted. As shown in FIG. 2A, the substrate sampling probe 230 includes an outer tube (e.g., outer capillary tube 232) extending from a proximal end 232*a* to a distal end 232*b* and an inner tube (e.g., inner capillary tube 234) disposed co-axially within the outer capillary tube 232. As shown, the inner capillary tube 234 also extends from a proximal end 234*a* to a distal end 234*b*. The inner capillary tube 234 comprises an axial bore providing a fluid channel therethrough, which as shown in the exemplary embodiment of FIG. 2 defines a sampling conduit 236 through which liquid can be transmitted from the substrate sampling probe 230 to the ion source 40 of FIG. 1 (i.e., the sampling conduit 236 is fluidly coupled to inner bore of the electrospray electrode 44). On the other hand, the annular space between the inner surface of the outer capillary tube 232 and the outer surface of the inner capillary tube 234 can define a desorption solvent conduit 238 extending from an inlet end 238*a* coupled to the desorption solvent source 231 (e.g., via conduit 231*a*) to an outlet end (adjacent the distal end 234*b* of the inner capillary tube 234). In some exemplary aspects of the present teachings, the distal end 234*b* of the inner capillary tube 234 can be recessed relative to the distal end 232*b* of the outer capillary tube 232 (e.g., by a distance h as shown in FIG. 2) so as to define a distal fluid chamber 235 of the substrate sampling probe 230 that extends between and is defined by the distal end 234*b* of the inner capillary 234 and the distal end 232*b* of the outer capillary tube 232. Thus, the distal fluid chamber 235 represents the space adapted to contain fluid between the open distal end of the substrate sampling probe 230 and the distal end 234*b* of the inner capillary tube 234. Further, as indicated by the curved arrows of FIG. 2, the desorption solvent conduit 238 is in fluid communication with the sampling capillary 236 via this distal fluid chamber 235. In this manner and depending on the fluid flow rates of the respective channels, fluid that is delivered to the distal fluid chamber 235 through the desorption solvent conduit 238 can enter the inlet end of the sampling conduit 236 for transmission to its outlet end 236*a* and subsequently to the ion source. It should be appreciated that though the inner capillary tube 234 is described above and shown in FIG. 2 as defining the sampling conduit 236 and the annular space between the inner capillary tube 234 and the outer capillary tube 232 defines the desorption solvent conduit 238, the conduit defined by the inner capillary tube 234 can instead be coupled to the desorption solvent source 231 (so as to define the desorption solvent conduit) and the annular space defined between the inner and outer capillaries 234, 232 can be coupled to the ion source so as to define the sampling conduit.

As shown in FIG. 2A, the desorption solvent source 231 can be fluidly coupled to the desorption solvent conduit 238 via a supply conduit 231*a* through which desorption solvent can be delivered from a reservoir of desorption solvent at a selected volumetric rate (e.g., via one or more pumping mechanisms including reciprocating pumps, positive displacement pumps such as rotary, gear, plunger, piston, peristaltic, diaphragm pump, and other pumps such as gravity, impulse and centrifugal pumps can be used to pump liquid sample), all by way of non-limiting example. Any desorption solvent effective to desorb analytes from the device and amenable to the ionization process are suitable for use in the present teachings. Similarly, it will be appreciated that one or more pumping mechanisms can be provided for controlling the volumetric flow rate through the sampling conduit 236 and/or the electrospray electrode (not shown), these volumetric flow rates selected to be the same or different from one another and the volumetric flow rate of the desorption solvent through the desorption solvent conduit 238. In some aspects, these different volumetric flow rates through the various channels of the substrate sampling probe 230 and/or the electrospray electrode 44 can be independently adjusted (e.g., by adjusting the flow rate of the nebulizer gas) so as to control the movement of fluid throughout the system. By way of non-limiting example, the volumetric flow rate through the desorption solvent conduit 238 can be temporarily increased relative to the volumetric flow rate through the sampling conduit 236 (e.g., after withdrawal of a substrate) such that the fluid in the distal fluid chamber 235 overflows from the open end of the substrate sampling probe 230 to clean any residual sample deposited by the withdrawn substrate and/or to prevent any airborne material from being transmitted into the sampling conduit 236. In other aspects, the volumetric flow rates can be adjusted such that the fluid flow is decreased upon insertion of the substrate so as to concentrate the desorbed analytes in a smaller volume of desorption solvent.

In accordance with various aspects of the present teachings, at least a portion of the substrate 220 can be inserted through the open end of the substrate sampling probe 230 such that the coated surface of the substrate upon which one or more analyte species are adsorbed are disposed in the desorption solvent (e.g., the desorption solvent within the distal fluid chamber 235). As shown in FIGS. 2A and 2B, for example, the exemplary substrate 220 comprises a coated surface 222 upon which a extraction phase (e.g., layer) has been formed and to which one or more analytes of interest have been adsorbed during extraction. Upon the coated surface 222 being inserted into the distal fluid chamber 235, the desorption solvent flowing from the desorption solvent conduit 238 and into the sampling conduit 236 via the distal fluid chamber 235 can be effective to desorb at least a portion of the one or more analytes adsorbed on the coated surface 222 such that any desorbed analytes flow with the desorption solvent into the inlet of the sampling conduit 236. As discussed in detail below, substrates in accordance with various aspects of the present teachings generally have coated surfaces exhibiting significantly increased surface areas relative to known devices, which can generally increase the amount of the one or more analytes that can be desorbed for analysis by the mass spectrometric system and thereby increase the sensitivity of the devices, methods, and systems described herein. For example, as shown in FIG. 2, the substrate 220 generally comprises an elongate cylindrical member having a plurality of protrusions formed on its outer surface, thereby increasing the surface area to which a target analyte can attach relative to a cylindrical device having the same maximum diameter. It will be appreciated that devices in accordance with the present teachings are generally able to be at least partially inserted into a fluid pathway provided by a substrate sampling probe 230, for example, by exhibiting a maximum outer dimension at the coated area that is less than the minimum inner dimension of the desorption solvent conduit 232 at the distal fluid chamber such that the desorption solvent therein is effective to desorb one or more analytes of interest from the substrate's coated area 222. Moreover, as discussed in detail below with reference to the exemplary substrates depicted in FIGS. 3-6, 8, and 10A, substrates in accordance with various aspects of the present teachings can include a bore at least partially extending through the elongate member so as to additionally provide an inner surface of the substrate that can surround the distal end of the inner capillary tube when the substrate is inserted into the distal fluid chamber 235, with the inner and outer surfaces of the substrate being disposed within the annulus between the desorption solvent conduit 232 and the sampling conduit 236, thereby further increasing the surface area that can be coated and disposed within the desorption solvent of the sampling probe 230. As shown in FIG. 2B, for example, this allows the length of the coated area 222 along the substrate's axis to be greater than the distance h (i.e., the distance between the distal end 232*b* of the outer capillary tube 232 and the distal end 234*b* of the inner capillary tube 234. Additionally or alternatively to the plurality of protrusions formed on the outer surface, the inner surface can additionally include a plurality of protrusions (e.g., radially-inward extending protrusions) to also increase the surface area of the substrate relative to device having a generally cylindrical bore (e.g., having a continuously curved surface) with the same minimum inner diameter so as to maximize the analytes desorbed in the vicinity of the inlet end of the sampling conduit.

It will be appreciated that substrate sampling probes in accordance with the present teachings can have a variety of configuration and sizes, with the depiction of substrate sampling probe 230 of FIG. 2 representing one exemplary depiction. By way of non-limiting example, the dimensions of an inner diameter of the inner capillary tube 234 can be in a range from about 1 micron to about 1 mm (e.g., 200 microns), with exemplary dimensions of the outer diameter of the inner capillary tube 234 being in a range from about 100 microns to about 3 or 4 centimeters (e.g., 360 microns). Also by way of example, the dimensions of the inner diameter of the outer capillary tube 232 can be in a range from about 100 microns to about 3 or 4 centimeters (e.g., about 2-3 mm), with the typical dimensions of the outer diameter of the outer capillary tube 232 being in a range from about 150 microns to about 3 or 4 centimeters. The cross-sectional shapes of the inner capillary tube 234 and/or the outer capillary tube 232 can be circular, elliptical, superelliptical (i.e., shaped like a superellipse), or even polygonal (e.g., square). Moreover, the inner diameter (or cross-sectional area) of the inner or outer capillary tubes 234, 232 need not be constant along the length of the capillary, but can instead include at least a portion having a smaller or larger diameter or cross-sectional area relative to other portions of the same inner or outer capillary tube 234, 232. In some other aspects, the cross-sectional area or a diameter of a portion of the distal fluid chamber 235 can be larger than an internal cross-sectional area or diameter of a proximal portion of the outer capillary tube 232, so as to enable the distal end 232*b* of the outer capillary tube 232 to receive a device having at least one dimension larger relative to the diameter of the proximal portion of the outer capillary tube (e.g., an substrate having a width greater than about 2 mm). Additional details regarding sampling probes suitable for use in the system of FIG. 1 and modified in accordance with the present teachings can be found, for example, in U.S. Pub. No. 20130294971 entitled "Surface Sampling Concentration and Reaction Probe" and U.S. Pub. No. 20140216177 entitled "Method and System for formation and Withdrawal of a Sample From a Surface to be Analyzed" the teaching of which are hereby incorporated by reference in their entireties.

In addition to the exemplary substrates described below with reference to FIGS. 3-6, 8, and 10-12 in accordance with various aspects of the present teachings, it will be appreciated the substrate configuration (e.g., fibers, blades, microtips, pins, or mesh) and/or SPME coating (e.g., HLB-PAN, C18-PAN, antibodies, etc.) suitable for use with the system of FIG. 1 is not particularly limited. Indeed, any known substrate and coating chemistries known in the art or hereafter developed and modified in accordance with the present teachings can be used in the methods and systems disclosed herein. Exemplary devices suitable for use in accordance with various aspects of the present teachings are described, for example, in U.S. Pat. No. 5,691,205, entitled "Method and Devise for Solid Phase Microextraction and Desorption" and PCT Pub. No. WO2015188282 entitled "A Probe for Extraction of Molecules of Interest from a Sample," the teachings of which are hereby incorporated by reference in their entireties.

Though any known device can be used or modified to be used in the system 10 of FIG. 1 incorporating a substrate sampling probe 30 in accordance with various aspects of the present teachings, additional or alternative aspects of the present teachings provide for systems in which the substrate and/or the substrate sampling probe are configured so as to increase the sensitivity of the extraction-based workflows described herein. Whereas known devices generally comprise narrow cylindrical fibers or opposed planar surfaces (see e.g., U.S. Pat. No. 5,691,205 and PCT Pub. No. WO2015188282), some aspects of the present teachings provide for the configuration of devices and/or the substrate sampling probe such that the substrate (or a portion thereof) is shaped so as to maximize the surface area of the coated portion of the substrate that is placed in contact with the desorption solvent, thereby increasing the amount of analytes that can be adsorbed thereto and subsequently desorbed into the desorption solvent adjacent the inlet end of the sampling conduit. Additionally or alternatively, in some aspects, the devices and/or the substrate sampling probe can be configured so as to minimize the dead space about the inlet end of the sampling conduit while providing sufficient clearance for the flow of desorption solvent about the coated portion(s) of the substrate. In this manner, the desorbed analytes can be contained within a minimum volume of desorption solvent, thereby decreasing dilution and/or sample loss and improving instrument response and sensitivity. As will be appreciated by a person skilled in the art in light of the present teachings, considerations for increasing the surface area of the coated portion of the substrate disposed in contact with the desorption solvent can be balanced with considerations for reducing the volume of dead space (e.g., decreasing the volume of desorption solvent) so as to optimize the sensitivity of the disclosed devices, systems, and methods.

Figure 3B:
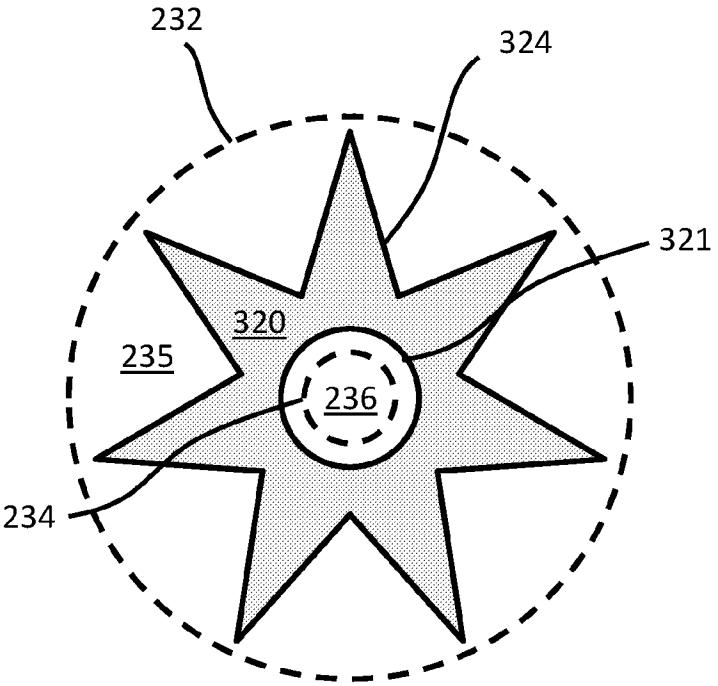
FIGS. 3A-B schematically depict an exemplary substrate suitable for use with the system of FIG. 1 in accordance with various aspects of the present teachings.
Figure 3A:
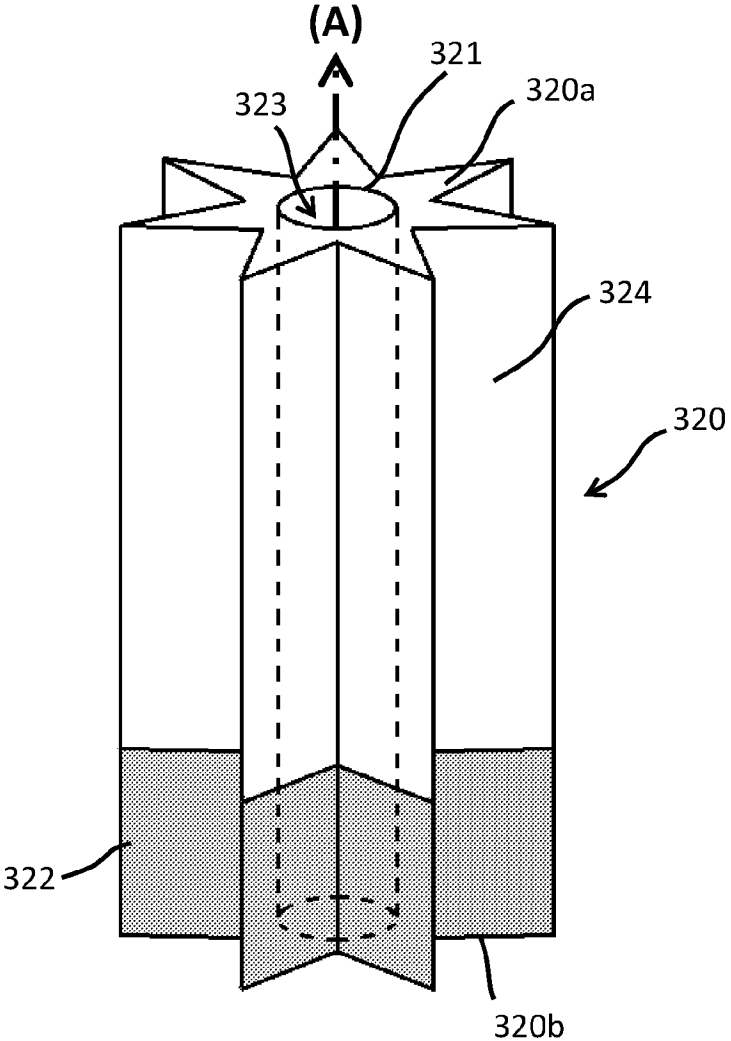
Figure 4:
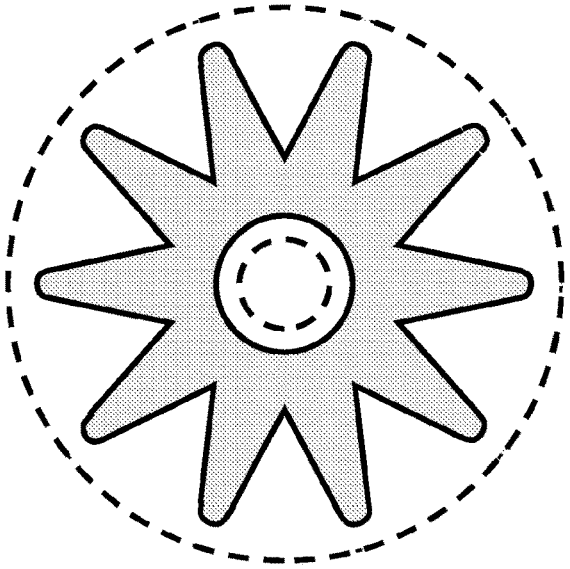
FIG. 4 schematically depicts another exemplary substrate suitable for use with the system of FIG. 1 in accordance with various aspects of the present teachings.

With reference to FIGS. 3A and 3B, an exemplary substrate 320 having a coated surface 322 exhibiting increased desorbable surface area relative to known substrates in accordance with various aspects of the present teachings is depicted. As shown, the substrate 320 configured for insertion into the open end of the exemplary sampling probe 230 of FIG. 2 generally comprises an elongate member extending between a first end 320*a* and a second end 320*b* along an outer surface 324 that has a cross-sectional shape axisymmetric about a central longitudinal axis (A). Though the cross-sectional shape of the elongate member's outer surface can be any shape in accordance with the present teachings, the particular exemplary cross-sectional shape of the outer surface 324 depicted in FIGS. 3A and 3B resembles a star in that a plurality of protrusions (e.g., at least three) extend to six points radially-outward from the minimum diameter of the outer surface 324. It will be appreciated in accordance with the present teachings that the relative size, number, and positioning of the protrusions is not limited to that depicted in the figures but can be of a variety of configurations so as to increase the surface area of the device to which analytes can adsorb relative, for example, to a cylindrical SPME device having the same maximum outer diameter at the coated surface 322. By way of example, as shown in FIG. 4, another exemplary substrate in accordance with the present teachings includes ten protrusions that terminate in rounded terminal surfaces. In any event, the maximum outer diameter of the coated surface 322 from which analytes can be desorbed by the sampling probe 230 (e.g., as depicted in FIGS. 2B) should be less than the minimum inner diameter of the distal fluid chamber 235 defined at least partially by the outer capillary tube 232.

Moreover, as shown in phantom in FIG. 3A, in accordance with various aspects of the present teachings, the substrate 320 can additionally include a bore 323 that extends through its entire length from the first end 320*a* to the second end 320*b*, thereby defining an inner surface 321 to which an adsorption coating 322 can additionally be applied. It will be appreciated that though the exemplary bore 323 is shown to have a circular cross-sectional shape, bores in accordance with the present teachings can have a variety of shapes and lengths. For example, the bore 323 need not extend entirely through the elongate member as shown in FIG. 3A but preferably extends at least through the second end 320*b* to be inserted within the distal fluid chamber 235 so as to accommodate the inner capillary tube 234 at least partially within the bore 323 and to allow the desorption solvent to flow from the desorption solvent conduit 238 into the sampling conduit 236 during sampling from the substrate 320 within the open port of the sampling probe 230. For example, the bore 323 can be a blind bore that extends from the second end 320*b* for a length sufficient to allow the length of the coated area 222 along the substrate's axis to be fully inserted within desorption solvent at the distal fluid chamber 235.

Figure 6:
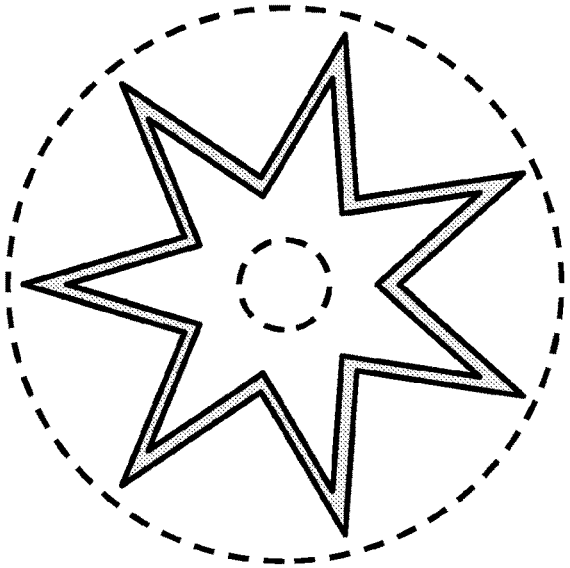
FIG. 6 schematically depicts another exemplary substrate suitable for use with the system of FIG. 1 in accordance with various aspects of the present teachings.
Figure 5:
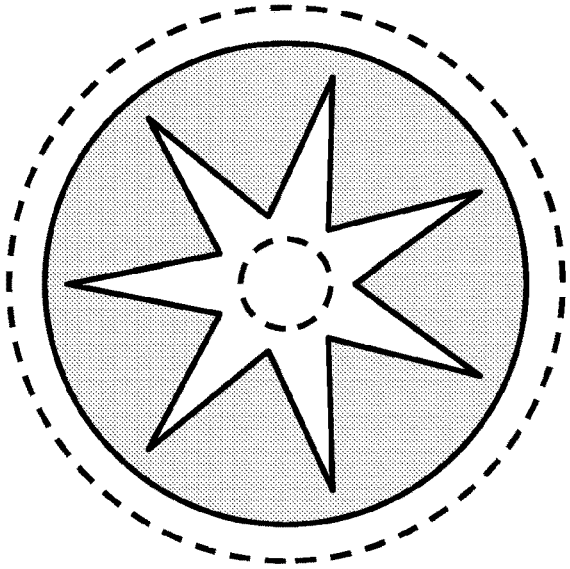
FIG. 5 schematically depicts another exemplary substrate suitable for use with the system of FIG. 1 in accordance with various aspects of the present teachings.

Likewise, the bore 323 need not be circular but can have a variety of shapes corresponding, for example, to the shape of the inner capillary tube 234, which as noted above can be circular, elliptical, superelliptical (i.e., shaped like a superellipse), or even polygonal (e.g., square). Moreover, with reference to FIG. 5, it will be appreciated that the protrusions can alternatively be formed on the inner surface of the bore, thereby increasing the inner surface area within the bore, with the minimum diameter of the bore being larger than the maximum outer diameter of the inner capillary tube 234 (as depicted in FIG. 2A). In such aspects as shown in FIG. 5, the outer surface can exhibit a circular cross-sectional shape having a diameter that is less than the inner diameter of the outer capillary tube of the sampling probe. Indeed, in various aspects in accordance with the present teachings, each of the outer and inner surfaces can include variations between the maximum and minimum cross-sectional diameters about the perimeter of the cross-sectional shapes such that each surface includes a plurality of protrusions so as to further increase the surface area of the coated area 322 that can be exposed to desorption solvent within the sampling probe, as depicted in FIG. 6.

Figure 10A:
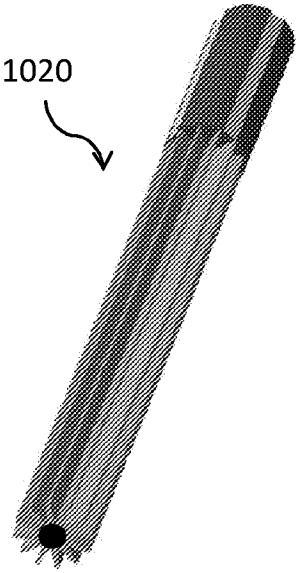
FIGS. 10A-D depict several exemplary substrates suitable for use with the system of FIG. 1 in accordance with various aspects of the present teachings.
Figure 10B:
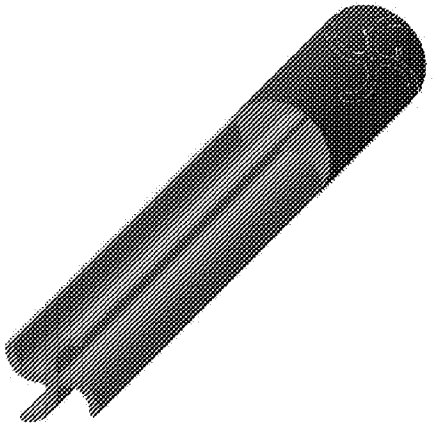
Figure 10C:
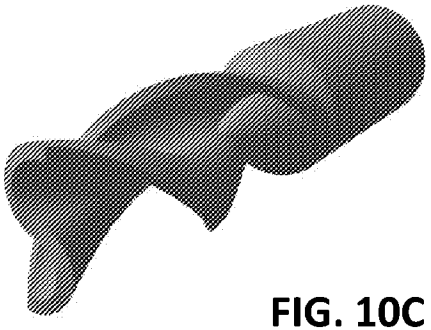
Figure 10D:
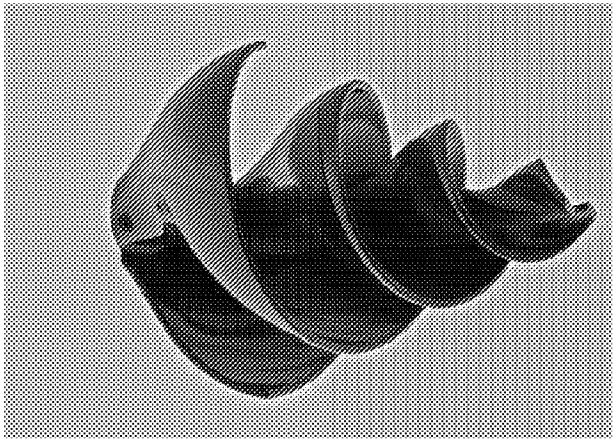
Figure 11:
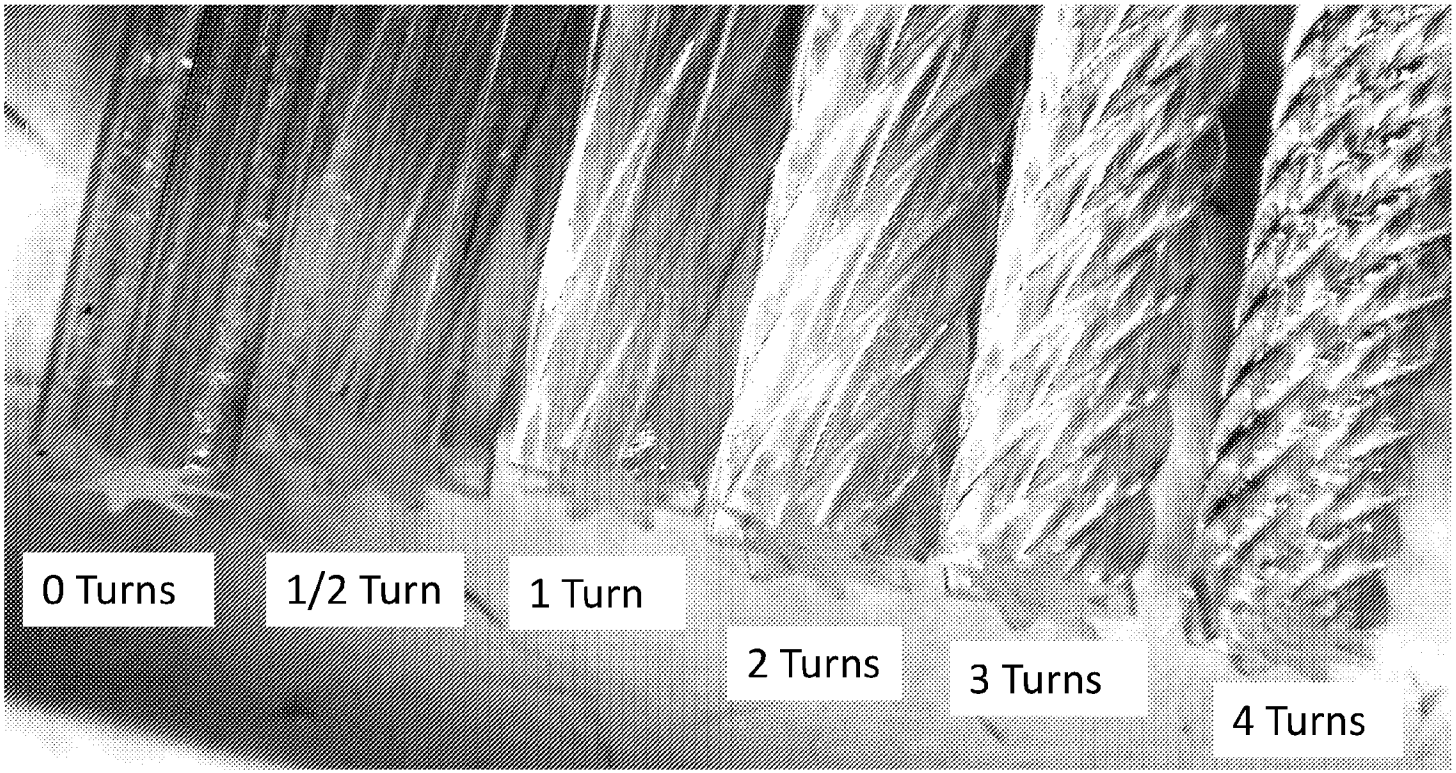
FIG. 11 depicts several exemplary substrates made from an extruded mold in accordance with various aspects of the present teachings.
Figure 12:
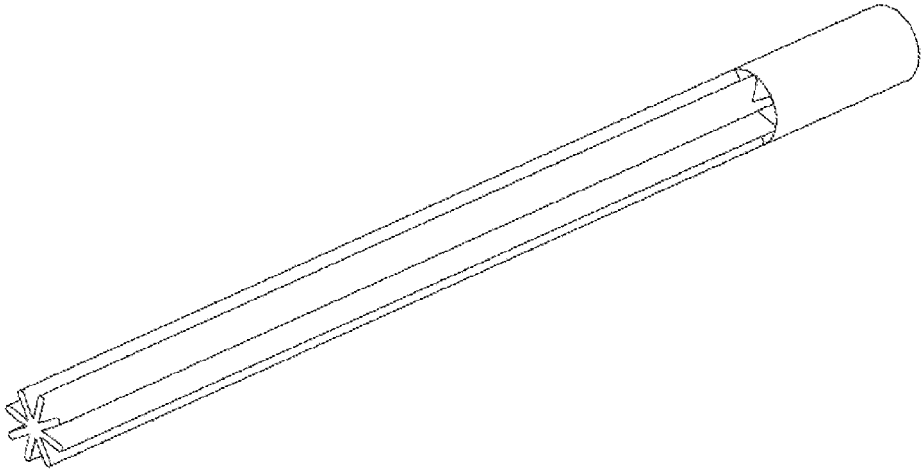
FIG. 12 depicts another exemplary substrate suitable for use with the systems of FIGS. 1 and 13 in accordance with various aspects of the present teachings FIG. 13, in a schematic diagram, illustrates an exemplary system comprising a substrate sampling interface having a feedback mechanism to maintain a liquid therein and fluidly coupled to an electrospray ion source of a mass spectrometer system in accordance with various aspects of the applicant's teachings depicts a feedback mechanism to maintain a liquid level height.

With reference now to FIG. 10A, another exemplary substrate 1020 onto which a extraction material may be deposited is schematically depicted in accordance with various aspects of the present teachings. As shown and discussed otherwise herein, substrates having particular cross sectional shapes can be made by the extrusion of a liquid, semi-liquid or softened material through a mold having a shape that defines the cross section of the extruded shape. Upon the material being formed, the extruded material can be allowed to solidify. For example, in some cases, the act of cooling the material from a higher temperature can be effective to solidify the material. In the case of a softened polymer material that is extruded through the mold, a curing step by the use of elevated temperature and/or UV curing, etc. can be used to assist in solidifying the material. In another non-limiting example, a softened glass like material can be extruded through the mold to create an elongated substrate having a particular shape. As will be appreciated in light of the present teachings, the cross sectional shapes of the mold can also be made such that the resulting substrates do not contain a bore and can include for example substrates including cross sectional shapes that are curved, as shown in FIG. 10B for example. In some aspects, the substrate can be twisted as it is being extruded so as to lead to substrates having cross sectional shapes that are rotationally different along their length, as shown for example in FIG. 10C. A similar effect can also be achieved if the mold is rotated. As depicted in FIG. 11, various degrees of twisting of the material can lead to varying shapes being produced from the same mold. Increasing the number of twists/turns per unit of the longitudinal length (or alternatively twists/unit of time, when the draw of the material being twisted is either constant or varies) of the substrate can lead to increasing degrees of surface area. Such twisted substrates can also allow for an increased degree of analyte desorption when such substrates are inserted into a solvent and are rotated. For example, the substrate's additional folds and surface area can increase the degree of turbulence and can assist in increased mass transfer from the surface when placed into solvent. The twisted substrates can also assist in inducing vertical movement of solvent which aids in mass transfer from the surface. In various aspects, the mold or substrate can be rotated/twisted at varying rates during the extrusion process. In yet other aspects, the mold can be modified during the extruding process providing shapes such as for example the Harman Lily Impeller as depicted in FIG. 10D.

In addition, in addition to the substrates depicted herein, such as one or more of the substrates containing a bore and a plurality of protrusions as otherwise described herein, it will be appreciated that these substrates can be modified by removal of the bore to create substrates comprising a solid core such as those depicted in FIGS. 10B, 10C, 11 and 12. It would be understood that in the event that such substrates not containing a bore are utilized or ones that were previously known SPME substrate, for example, modifications to the substrate sampling probe can be made. For example, in order to accommodate a substrate not containing a bore, an enlarged distal fluid chamber may be made by positioning the inner capillary of the open port probe described herein at a position such that the distal end of the inner capillary is recessed further from the distal end of the outer capillary.

In this manner, the exemplary substrates described herein can expose a relatively large coated surface area for adsorption of the analytes within a sample, as well as dispose the coated surface area relatively close to the inlet end upon insertion of the substrate 320 into the sampling probe. Moreover, it will be appreciated that upon insertion of the substrate 320 such that the bore 321 surrounds the exemplary inner capillary tube 234 of FIG. 2B, the substrate 320 can be effective to displace a substantial portion of the desorption fluid normally occupying the distal fluid chamber 235, thereby decreasing the dead volume space and further increasing the concentration of analytes within the desorption fluid sampled by the inlet end of the sampling conduit 236. In various aspects, substrates in accordance with various aspects of the present teachings can thus be configured to occupy at least 30 percent of the volume of the substrate sampling device's substrate-receiving port (e.g., distal fluid chamber 235 of substrate sampling probe 230). That is, in various aspects, less than 70% of the volume of the distal fluid chamber, for example, may be occupied by desorption solvent upon insertion of the substrate. By way of non-limiting example, substrates in accordance with various aspects of the present teachings can be configured to occupy at least 30 percent (e.g., at least 40%, at least 50%, at least 60%, at least 70%, at least 80%, at least 90%) of the distal fluid chamber upon insertion of the substrate. It will be also be appreciated by the skilled artisan in accordance with various aspects of the devices, methods, and systems described herein, that the particular configuration of the substrate and/or the sampling interface can be optimized so as to increase the surface area of the extraction phase subject to desorption within a minimal volume of desorption solvent so as to provide for increased concentrations of the one or more analyte species desorbed from the device in the desorption solvent delivered to the ion source of the MS system. Moreover, in light of the increased surface area provided by the devices in accordance with various aspects of the present teachings, extraction times can be reduced (thereby increasing throughput, reducing dilution) and/or the thickness of the coated surface area 322 can be reduced, which can likewise reduce the extraction and desorption steps of the substrates described herein relative to known substrate configuration (e.g., fibers, blades, micro-tips, pins, or mesh).

Figure 7:
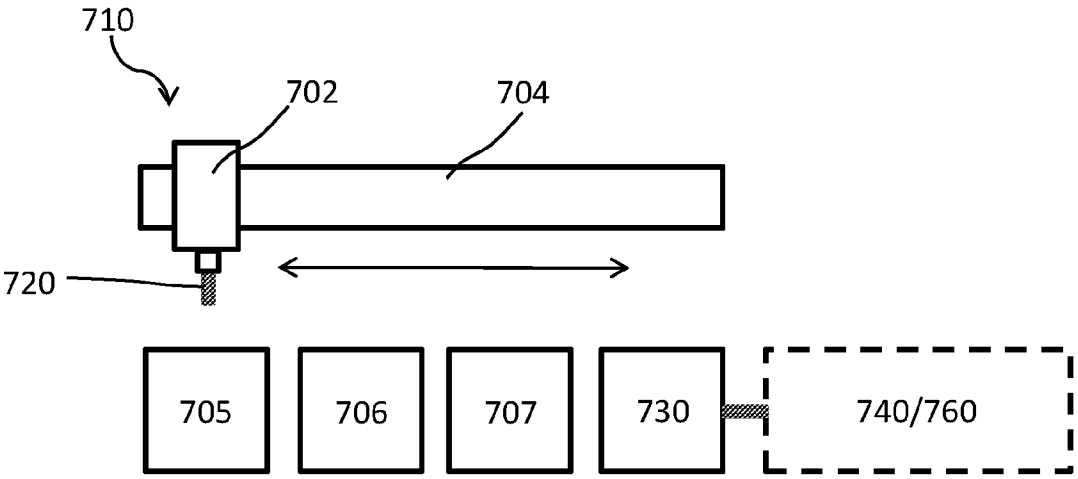
FIG. 7 depicts in schematic diagram an exemplary automated system for sample analysis in accordance with various aspects of the applicant's present teachings
Figure 8:
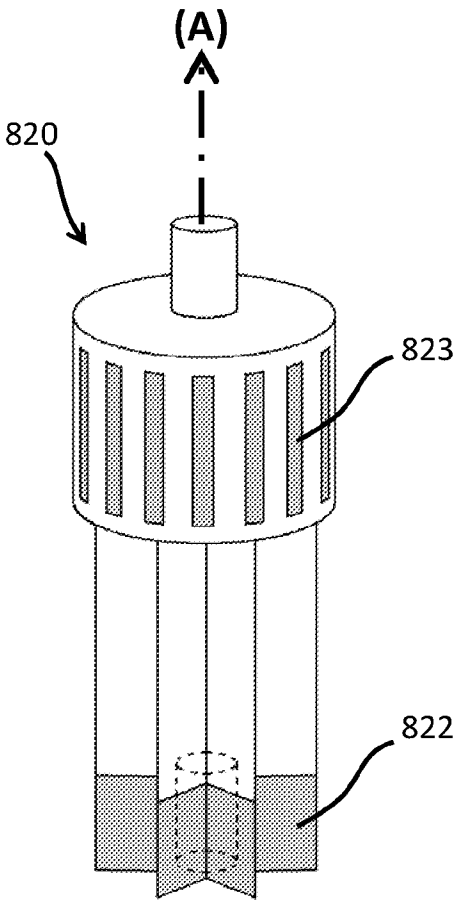
FIG. 8 depicts an exemplary rotatable substrate in accordance with various aspects of the applicant's present teachings.

With reference now to FIG. 7, an exemplary automated sample analysis system 710 in accordance with various aspects of the present teachings is depicted. As shown in FIG. 7 and discussed otherwise herein, the present teachings reduce and/or eliminate the need for complex and time-consuming sample preparation steps such as liquid chromatography, thus enabling substrate extraction-MS analysis in an automated fashion. As shown, the exemplary system 710 includes an actuation mechanism 704 (e.g., robotic arm, stage, electromechanical translator, step motor, etc.) that is coupled to a sample holder 702 configured to grip, hold, or otherwise couple to a substrate 720. One exemplary robotic system suitable for use in accordance with the present teachings is the Concept-96 autosampler marketed by PAS Technologies. Under the control of a controller (not shown) and without human intervention, for example, the actuation mechanism 704 can be configured to transfer the substrate 720 through the complete sample preparation workflow including, for example, conditioning the substrate in element 705 (e.g., coating or otherwise functionalizing the surface to enable extraction of an analyte of interest), extraction/enrichment of the analytes from the sample in element 706 (e.g., by immersing the coated surface in the sample, with or without vortexing), rinsing the extracted sample in element 707 (e.g., by immersing the substrate having analytes adsorbed thereto in $H_2O$ so as to remove some interfering molecules, salts, proteins, etc.), and inserting the rinsed substrate into the substrate sampling probe 730, for example, such that the inner capillary tube of the sampling probe 730 is disposed within the bore of the substrate 720. As discussed otherwise herein, the substrate sampling probe 730 is configured to desorb the analytes from the substrate utilizing the desorption solvent in flowing fluid contact with the coated portion of the substrate and delivering the desorption solvent containing said desorbed analytes directly to the ion source 740/mass spectrometer system 760 for ionization/mass spectrometric analysis. In various aspects, the desorbing solvent can be pumped continuously through the substrate sampling probe 730, or alternatively, can be set in stand-by mode, for example, during the extraction step. It will also be appreciated that one or more of these steps can be excluded in an automated sample protocol. By way of non-limiting example, rather than perform on-line fiber conditioning and extraction (adsorption from the sample) with the system 710, these steps may be performed "off-line," for example in a remote location with the substrate having analytes adsorbed thereto being sent to the laboratory for desorption and MS analysis.

In accordance with various aspects of the present teachings, the system 710 can additionally provide for the rotation of the substrate (e.g., about its central longitudinal axis) while the coated surface of the substrate 720 disposed within the sample in element 706 and/or desorption solvent of the sampling probe 730 to improve the efficiency between the substrate 720 and the surrounding solution. It will be appreciated that the protrusions on the inner and/or outer surfaces of the substrate 720 as otherwise discussed herein can create turbulent flow within the sample, which can significantly improve the kinetics for sample extraction/desorption. By way of non-limiting example, a person skilled in the art would appreciate that the sample holder 702 and/or actuation mechanism 704 can be configured to rotate the substrate. Alternatively, with reference to FIG. 8, in some exemplary aspects the substrate 820 itself can function as a rotor to a stator disposed in the sample holder 702 so as to provide for rotation of the substrate about its central longitudinal axis (A). By way of example, the substrate 820 can include on its end opposite the coated end 822 an array of magnets 823 that can be utilized to generate the rotation of the substrate 820.

Figure 9:
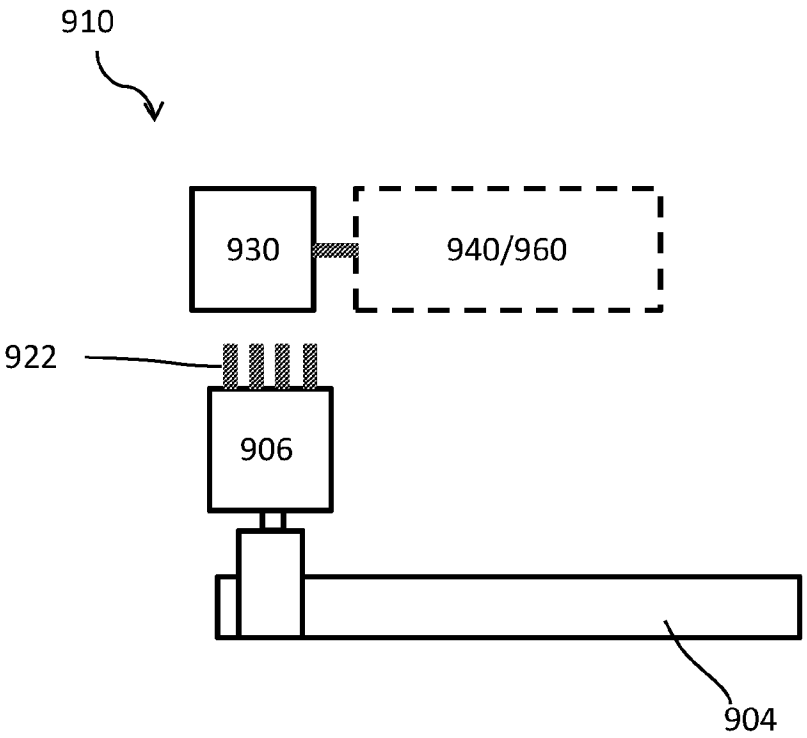
FIG. 9 depicts in schematic diagram another exemplary automated system for sample analysis in accordance with various aspect of the applicant's present teachings.

With reference now to FIG. 9, another exemplary automated system 910 in accordance with various aspects of the present teachings is depicted. System 910 is similar to that depicted in FIG. 7 in that it includes an actuation mechanism 904, but differs in that the system 910 includes a specimen stage 906 configured to support a plurality of substrates 922 (e.g., an array of substrates). In such a system, for example, a controller (not shown) can control the movement of the actuator in the x-y-z planes to sequentially transfer each of the SPME fibers to the substrate sampling probe 930 for desorbing the analyte therefrom and delivering the desorbed analytes directly to the ion source 940/mass spectrometer system 960 via fluidic coupling for ionization/mass spectrometric analysis. Additionally, as with system 710 of FIG. 7, the system 910 can utilize step-wise protocols (e.g. steps 705, 706, 707 . . . ). Such steps can be achieved simultaneously for multiple devices for high-throughput.

Though the exemplary sampling probe 30 is depicted in FIG. 1 as receiving the substrate 20 in a horizontal orientation (i.e., from the left), it will be appreciated that sampling probes suitable for use in the system of FIG. 1 and modified in accordance with the present teachings can be oriented in a variety of orientations, including upside down (i.e., with the probe in a vertical orientation and the distal open port facing down) as shown in FIG. 9 and described, for example, in U.S. Pub. No. 20130294971 entitled "Surface Sampling Concentration and Reaction Probe" and U.S. Pub. No. 20140216177 entitled "Method and System for Formation and Withdrawal of a Sample From a Surface to be Analyzed," the teaching of which are hereby incorporated by reference in their entireties. Other non-limiting, exemplary sampling probes that can be modified in accordance various aspects of the systems, devices, and methods disclosed herein can be found, for example, in an article entitled "An open port sampling interface for liquid introduction atmospheric pressure ionization mass spectrometry," authored by Van Berkel et al. and published in Rapid Communication in Mass Spectrometry 29(19), 1749-1756, which is incorporated by reference in its entirety.

In accordance with various aspects of the present teachings, the exemplary substrates disclosed herein can be utilized in a substrate sampling probe to effect a separation. In particular, a substrate having more than one analyte adsorbed thereto can be inserted into the opening of a substrate sampling probe into which solvent is flowing. A gradient can then be created in the solvent, which varies the composition of solvent flowing into the distal fluid chamber over time in either a continuous or step-wise fashion. Because the analytes adsorbed to the substrate can have various affinities for the different solvent compositions, the analytes will be desorbed at different times depending on the composition of the solvent present in the distal fluid chamber. Accordingly, the analytes can be extracted in a selective manner and introduced downstream for further analysis (e.g., into a mass spectrometer). In such exemplary aspects, the method and apparatus can perform a separation similar to that performed in LC, but without the added apparatus or sample preparation required. Moreover, the solvent compositions introduced into the open port probe can be similar to those that would be utilized in liquid chromatography. Indeed, in some aspects, the separation performed by the substrate sampling probe can be performed using substrates other than those described herein. For example, substrates such as those for example disclosed in U.S. Pat. No. 6,759,126, which is incorporated by reference herein, can be introduced into a substrate sampling probe with the solvent composition introduced into the distal fluid chamber being varied over time so as to cause selective desorption from the coating material during the elution gradient.

In various aspects, the separation can be performed by using two pumps, one pump for the delivery of high aqueous solvent and the other pump for delivery of high organic solvent with a controller controlling the pump and the flow rate of each solvent, which can in some aspects be continuously adjusted. The two streams can then be mixed together before being introduced into the distal fluid chamber or the substrate sampling probe. Unlike in an HPLC gradient in which the total flow rate of the combined streams are kept constant, the total flow rate with high aqueous solvent ratio is lower than the total flow rate with high organic solvent ratio when used with the substrate sampling probe due to the aspiration and nebulizing flow rate being viscosity dependent. That is, the flow rate of solvent leaving the distal fluid chamber through the sampling conduit can vary depending on viscosity—a lower aspiration flow rate for high viscosity solutions such as aqueous solvents. It will be appreciated that the relationship between flow rate and the solvent composition can be pre-determined before an actual run and/or be subject to real-time control by a feedback control mechanism.

In certain aspects, the separation can be performed utilizing a step gradient, which utilizes a single solvent inlet. Two streams from two different pumps (e.g., aqueous and organic) can be merged together before being introduced into the desorption solvent conduit. In this exemplary setup, the solvent composition is not continuously adjusted, but changes between several certain ratios (e.g., pure aqueous, 30:70 water/organic, 50:50 water/organic, 70:30 water/organic, pure organic). This allows the use of thicker stationary phase coatings and allows for complete elution of a targeted analyte before switching to the next solvent composition.

Figure 13:
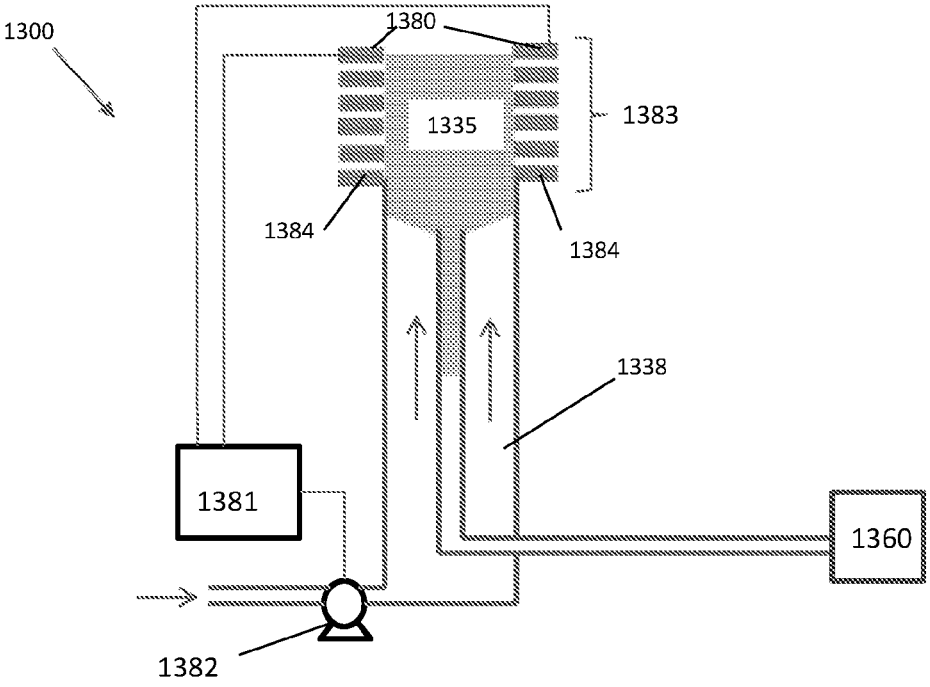
Figure 14:
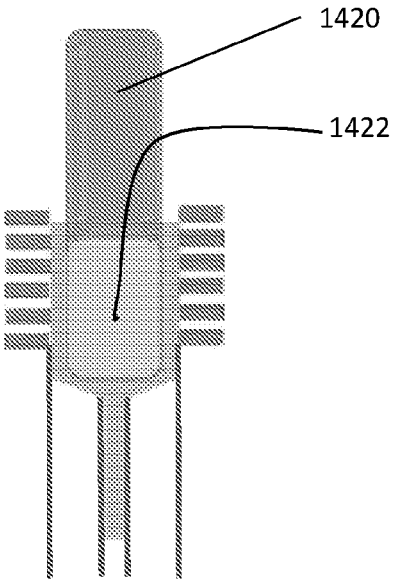
FIG. 14 depicts, in a schematic diagram, an exemplary substrate being inserted into the system of FIG. 13.

Now referring to FIG. 13, a system 1300 in accordance with various aspects of the present teachings can include a liquid level sensor system 1300 may be present in and around the distal fluid chamber 1335 of the substrate sampling probe to monitor the liquid level within the chamber. A feedback circuit may be associated with the liquid level monitor that controls the flow of solvent to the desorption solvent conduit 1338. In some aspects, the liquid level monitor can determine conductivity between two electrodes 1380 spaced apart and set at a height in the distal fluid chamber 1335 at which a level of liquid is desired to be maintained. Once the liquid height contacts the two electrodes, a circuit is completed and signals sent to a controller 1381 indicating the liquid has reached the defined height. Upon reaching such a level, the liquid level can be reduced by having the controller 1381 lower the flow rate of solvent into the desorption solvent conduit 1338 by sending a signal to a pump 1382 that reduces the flow of the desorption solvent until such time that the solvent level drops below the level of the two electrodes 1380. Such a mechanism can assist in reducing the overflow and spillage of solvent when a substrate is inserted into the distal fluid chamber 1335 which otherwise would cause overspill. By automatically reducing the flow rate upon contacting a substrate with the desorption solvent in the distal fluid chamber, spillage of the solvent can be reduced or avoided altogether. In some aspects, the electrodes 1380 can be part of an array of electrodes pairs 1383, each pair situated at a different height in the distal fluid chamber and operably connected to the controller 1381. Each electrode pair can define a different height of liquid in the chamber and the controller may be operated to control the pump 1382 such that certain levels of liquid can be maintained. For example, with reference to electrode pair 1384 situated at bottom of the distal fluid chamber 1335, if the flow of desorption solvent drops below this level, the circuit between the controller 1381 and electrode pair 1384 would be broken, signaling to the controller 1384 that the distal fluid chamber 1335 is empty. The controller 1381 can then take corrective action by controlling pump 1382 to increase the flow rate of desorption solvent into the desorption solvent conduit and distal fluid chamber until it is filled, such as when a circuit is completed by electrodes 1380. As would be appreciated, any other level of liquid can be maintained within the desorption solvent conduit, by having the controller monitor the fluid heights of the other electrode pairs in the array 1383. With reference now to FIG. 14, a substrate 1420 having a SPME material 1422 coated thereon is depicted within the distal fluid chamber 1335 in the system of FIG. 13. As the substrate 1420 is inserted into the distal fluid chamber 1335, the level of liquid is maintained and overspill of the desorption solvent is minimized, the analyte(s) are desorbed from the SPME coating and then transferred to the mass spectrometer analyzer 1360.

In addition to the use of an actuation mechanism 904 for controlling the movement of individual substrates 922 relative to the sampling probe 930 as otherwise described herein, the system 910 depicted in FIG. 9 can additionally provide for the incorporation of alternative techniques for delivering a sample to be tested into the sampling probe 930, including direct injection of a liquid into the probe's solvent stream. As an alternative to direct liquid injection, the present teachings allow for a liquid sample to be injected into an open port probe via an acoustic liquid droplet dispenser disposed, for example, under sample wells (e.g., a micro-titer plate) on the specimen stage. Alternatively, a tube for delivering the droplets from the acoustic transducer to the sampling probe could instead be actuated, as opposed to the sample plate itself. An exemplary acoustic liquid handling device suitable for use with the present system is marketed under the name Echo® 525 liquid handler manufactured by LabCyte, Inc. of Sunnyvale, Calif., which includes an acoustic transducer capable of ejecting a droplet vertically from a liquid sample well. In certain aspects, the acoustic dispenser can be disposed below the "upside down" sampling probe 930 (and directly below the ion source 940, which can also be oriented vertically) to eject the droplets from the sample wells vertically into the probe's distal fluid chamber, thereby avoiding long fluid transfer lines associated with an orientation in which both the acoustic dispenser and sampling interface are above the ion source and/or separated therefrom by a large distance. Such an orientation can enable the use of shorter liquid transport lines, relatively smaller diameter tubing, lower flow rates, shorter analysis time, and decreased nebulizer flow to the ion source 940, which often generates the negative pressure that drives the fluid from the sampling conduit of the sampling probe 930. Additionally, because the acoustic dispenser provides contactless transfer, the risk of carryover between samples can be reduced.

In addition, the use of an acoustic dispenser for liquid sampling into the probe 930 can additionally enable the use of different carrier fluids (other than the desorption solvent otherwise discussed herein). For example, by using a carrier fluid that is immiscible with the sample, the acoustic dispenser can eject small aqueous sample droplets (e.g., as small as 2.5 nL) into the distal fluid chamber of the "upside-down" probe 930 and maintain the droplets concentration over the length of the transport line (e.g., sampling conduit) to the ion source due to the immiscibility between the sample and the carrier fluid, thereby preventing significant dilution of the liquid sample plug and providing a significantly sharper peak being detected at the mass spectrometer. By way of example, the carrier fluid can be mineral oils, Fluorinert, or other suitable liquids that are immiscible with the liquid sample. For example, while dilutions of about 1000× would be typical when using a transfer line of approximately 50 cm, by keeping the injected volume at 2.5 nL and reducing the transport line to about 10 cm using an "upside-down" configuration, sub-attomole detection limits can be obtained in a very short time frame (e.g., a few seconds) for each sample. It has been demonstrated that the MS signal generated from plugs of sample droplets within immiscible oil provide a sharp contrast between the leading and trailing edge of the sample plug, as described for example in an article entitled "Label free screening of enzyme inhibitors at femtomole scale using segmented flow electrospray ionization mass spectrometry," authored by Sun et al. and published in Analytical Chemistry 84(13), 5794-5800 (2012), which is incorporated by reference in its entirety.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

What is claimed is:

1. A substrate for sampling a specimen, comprising:

an elongate member extending from a first end to a second end spaced apart from the first end by an outer surface, wherein the second end is sized and configured to be inserted within a substrate sampling probe, the substrate sampling probe comprising:

an outer capillary tube extending from a proximal end to a distal end; and an inner capillary tube extending from a proximal end to a distal end and disposed within said outer capillary tube, wherein said distal end of the inner capillary tube is recessed relative to the distal end of the outer capillary tube so as to define a distal fluid chamber between the distal end of the inner capillary tube and the distal end of the outer capillary tube, wherein said inner and outer capillary tubes define a desorption solvent conduit and a sampling conduit in fluid communication with one another via said distal fluid chamber, a bore extending from the second end at least partially through the elongate member, the bore defining an inner surface of the elongate member sized and configured to at least partially surround the distal end of the inner capillary tube, wherein at least a portion of said outer surface, said inner surface, and said second end of the elongate member comprises a surface coated with an extraction phase configured to adsorb one or more analyte species thereto, wherein the cross-sectional shape of the elongate member at the coated surface portion comprises a plurality of protrusions on at least one of the inner and outer surfaces such that desorption solvent flowing from the desorption solvent conduit into the sampling conduit through the distal fluid chamber can desorb said one or more analyte species adsorbed to the coated surface portion.

2. The substrate of claim 1, wherein the inner surface of the bore at the coated surface portion comprises a circular cross-sectional shape.

3. The substrate of claim 2, wherein the cross-sectional shape of the outer surface comprises a star-like shape.

4. The substrate of claim 1, wherein the outer surface of the elongate member at the coated surface portion comprises a circular cross-sectional shape and wherein the plurality of protrusions are formed in the inner surface.

5. The substrate of claim 1, wherein the elongate member extends along a longitudinal axis from its first end to its second end and wherein the elongate member is symmetric about the longitudinal axis at the coated surface portion.

6. The substrate of claim 1, wherein the coated surface comprises a solid phase extraction medium.

7. The substrate of claim 1, wherein the first end of the elongate member comprises a plurality of magnets.

8. A system for analyzing a chemical composition of a specimen, comprising:

a substrate sampling probe comprising:

an outer capillary tube extending from a proximal end to a distal end; and an inner capillary tube extending from a proximal end to a distal end and disposed within said outer capillary tube, wherein said distal end of the inner capillary tube is recessed relative to the distal end of the outer capillary tube so as to define a distal fluid chamberbetween the distal end of the inner capillary tube and the distal end of the outer capillary tube, wherein said inner and outer capillary tubes define a desorption solvent conduit and a sampling conduit in fluid communication with one another via said distal fluid chamber, said desorption solvent conduit extending from an inlet end configured to fluidly couple to a desorption solvent source to an outlet end in fluid communication with said distal fluid chamber, and said sampling conduit extending from an inlet end in fluid communication with said distal fluid chamber to an outlet end configured to fluidly couple to an ion source probe for discharging desorption solvent received at the inlet end of the sampling conduit into an ionization chamber in fluid communication with a sampling orifice of a mass spectrometer; and a substrate comprising an elongate member extending from a first end to a second end spaced apart from the first end by an outer surface, wherein the second end is sized and configured to be inserted within the distal fluid chamber, wherein the elongate member has a bore at least partially extending therethrough from the second end and defining an inner surface that is configured to at least partially surround the distal end of the inner capillary tube when the second end is inserted within the distal fluid chamber, and wherein at least a portion of said outer surface, said inner surface, and said second end of the elongate member comprises a surface coated with an extraction phase configured to adsorb one or more analyte species thereto, the cross-sectional shape of the elongate member at the coated surface portion comprises a plurality of protrusions in at least one of the inner and outer surfaces such that desorption solvent flowing from the desorption solvent conduit into the sampling conduit through the distal fluid chamber can desorb said one or more analyte species adsorbed to the coated surface portion.

9. The system of claim 8, wherein the cross-sectional shape of the outer surface of the coated surface portion is not circular and wherein the maximum outer dimension of the outer surface at the coated surface portion is less than the inner dimension of the outer capillary tube.

10. The system of claim 9, wherein the cross-sectional shape of the inner surface at the coated surface portion is circular and exhibits a minimum cross-sectional dimension greater than the outer dimension of the inner capillary tube.

11. The system of claim 10, wherein the cross-sectional shape of the outer surface at the coated surface portion comprises a star-like shape.

12. The system of claim 8, wherein the outer surface of the elongate member at the coated surface portion comprises a circular cross-sectional shape and wherein the plurality of protrusions are formed in the inner surface.

13. The system of claim 8, wherein the elongate member extends along a longitudinal axis from its first end to its second end and wherein the elongate member is symmetric about the longitudinal axis at the coated surface portion.

14. The system of claim 8, wherein the coated surface comprises a solid phase extraction medium.

15. The system of claim 8, further comprising a sample holder configured to insert the substrate within the sampling probe such that the coated surface portion is disposed within the distal fluid chamber.

16. The system of claim 15, wherein the sample holder comprises an actuation mechanism configured to rotate the elongate member about its longitudinal axis when the coated surface portion is disposed within the distal fluid chamber.

17. A method for performing chemical analysis, comprising:

providing a system according to claim 8;

inserting the second end of the elongate member into the distal fluid chamber of the substrate sampling probe such that at least a portion of the inner capillary tube is disposed within the bore of the elongate member;

flowing said desorption solvent through the desorption fluid pathway such that at least a portion of said one or more analyte species is desorbed from the coated surface portion and delivered to the ion source probe within said desorption solvent via the sampling conduit;

discharging said desorption solvent containing said portion of the one or more analyte species from said ion source probe so as to ionize said one or more analyte species; and performing mass spectrometric analysis on said one or more ionized analyte species.

18. The method of claim 17, wherein the cross-sectional shape of the outer surface of the coated surface portion is not circular and wherein the maximum outer dimension of the outer surface at the coated surface portion is less than the inner dimension of the outer capillary tube.

19. The method of claim 17, further comprising interacting said coated surface portion with a sample so as to adsorb said one or more analyte species to said coated surface portion.

20. The method of claim 17, further comprising rotating the elongate member about its longitudinal axis when the coated surface portion is disposed within the distal fluid chamber.

* * * * *